US006792645B2

(12) United States Patent
Ruff

(10) Patent No.: US 6,792,645 B2
(45) Date of Patent: Sep. 21, 2004

(54) LIGHTED COIL CLEANING TOOL

(76) Inventor: Timothy K. Ruff, 118 S. Pacific St., Apt. 11, Oceanside, CA (US) 92054

( * ) Notice: Subject to any disclaimer, the term of this patent is extended or adjusted under 35 U.S.C. 154(b) by 254 days.

(21) Appl. No.: 10/125,705

(22) Filed: Apr. 18, 2002

(65) Prior Publication Data

US 2003/0196293 A1 Oct. 23, 2003

(51) Int. Cl.[7] ..... A47L 9/30

(52) U.S. Cl. ..... 15/324; 15/398; 15/415.1; 15/416

(58) Field of Search ..... 15/398, 415.1, 15/416, 324, 395

(56) References Cited

U.S. PATENT DOCUMENTS

| | | | | |
|---|---|---|---|---|
| 2,637,062 A | * | 5/1953 | Sutton et al. | 15/324 |
| 2,679,068 A | | 5/1954 | Wied | |
| 3,848,291 A | * | 11/1974 | Morse | 15/322 |
| 4,053,962 A | | 10/1977 | McDowell | |
| 4,506,406 A | | 3/1985 | LaMonte | |
| 4,656,687 A | * | 4/1987 | Wei | 15/324 |
| 4,688,295 A | | 8/1987 | Starnes | |
| 4,694,529 A | | 9/1987 | Choiniere | |
| D293,141 S | | 12/1987 | Blocker | |
| 5,533,230 A | | 7/1996 | Rouda | |
| 5,983,443 A | * | 11/1999 | Redding | 15/324 |
| 6,032,328 A | | 3/2000 | Harmon et al. | |
| 6,493,903 B1 | * | 12/2002 | Super | 15/324 |

FOREIGN PATENT DOCUMENTS

JP 7-255650 * 10/1995

* cited by examiner

*Primary Examiner*—Terrence R. Till
(74) *Attorney, Agent, or Firm*—Dale J. Ream

(57) ABSTRACT

A coil cleaning tool for attachment to a vacuum cleaner hose includes a flattened tubular housing having opposed planar side faces connected by top and bottom walls, the top and bottom walls having a narrow width such that the entire tubular housing is very narrow and lender. The tubular housing includes a first end capable of being releasably coupled to a vacuum cleaner hose and a second end having a tapered construction and defining an air intake opening. A light housing having a battery powered LED is mounted atop the top wall of the tubular housing for illuminating a cleaning area. Each side face of the tubular housing may also define an auxiliary air intake opening with a slidable cover such that the air intake openings may be selectively opened or closed for the most efficient and convenient cleaning of hard to reach areas.

15 Claims, 6 Drawing Sheets

LIGHTED COIL CLEANING TOOL

BACKGROUND OF THE INVENTION

This invention relates generally to vacuum attachments and, more particularly, to a vacuum attachment for cleaning refrigerator coils and for illuminating the cleaning area when desired.

Adequately cleaning dirt, dust, pet hair, etc. from refrigerator coils or other hard to reach crevices is very difficult and virtually impossible using conventional vacuum sweeper attachments. Various vacuum cleaner hose attachments have been proposed in the art for cleaning between walls and furniture, cleaning furniture cushions, and the like. Although assumably effective for their intended purposes, existing devices are not effective for cleaning refrigerator coils or other cleaning areas having extremely low visibility. Existing devices are also not suitable for cleaning narrow and crowded areas in which the cleaning tool cannot be easily reoriented without first removing the tool completely from the cleaning area.

Therefore, it is desirable to have a coil cleaning tool that may be extended into an area adjacent to the condenser coils of a refrigerator. Further, it is desirable to have a coil cleaning tool which can suction air from selected directions without reorienting the tool. It is also desirable to have a coil cleaning tool which can illuminate the area being cleaned.

SUMMARY OF THE INVENTION

A coil cleaning tool for attachment to a vacuum cleaner hose includes a flattened tubular housing having one end capable of attachment to the hose of a vacuum cleaner and another end defining an air intake opening. A light housing having a light emitting diode and battery is positioned atop the tubular housing midway between the ends thereof. The light housing includes a switch for selectively energizing the light so that an area to be cleaned, such as the condenser coils of a refrigerator, may be illuminated when needed. The tubular housing may also define auxiliary air intake openings on each side face thereof. A panel is slidably coupled to a side face for selectively covering a corresponding auxiliary opening. Therefore, appropriate air intake openings may be opened or closed for providing suction at a desired area without having to completely reorient the tubular housing.

Therefore, a general object of this invention is to provide a coil cleaning tool for attachment to a vacuum cleaner hose for cleaning refrigerator coils and other narrow crevices.

Another object of this invention is to provide a coil cleaning tool, as aforesaid, that includes an elongate, narrow construction for extending into an appliance or other narrow area to be cleaned.

Still another object of this invention is to provide a coil cleaning tool, as aforesaid, which selectively illuminates a cleaning area during use such that a user need not hold or position a flashlight.

Yet another object of this invention is to provide a coil cleaning tool, as aforesaid, having multiple air intake openings that may be selectively opened for cleaning a desired area without having to reposition the cleaning tool.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
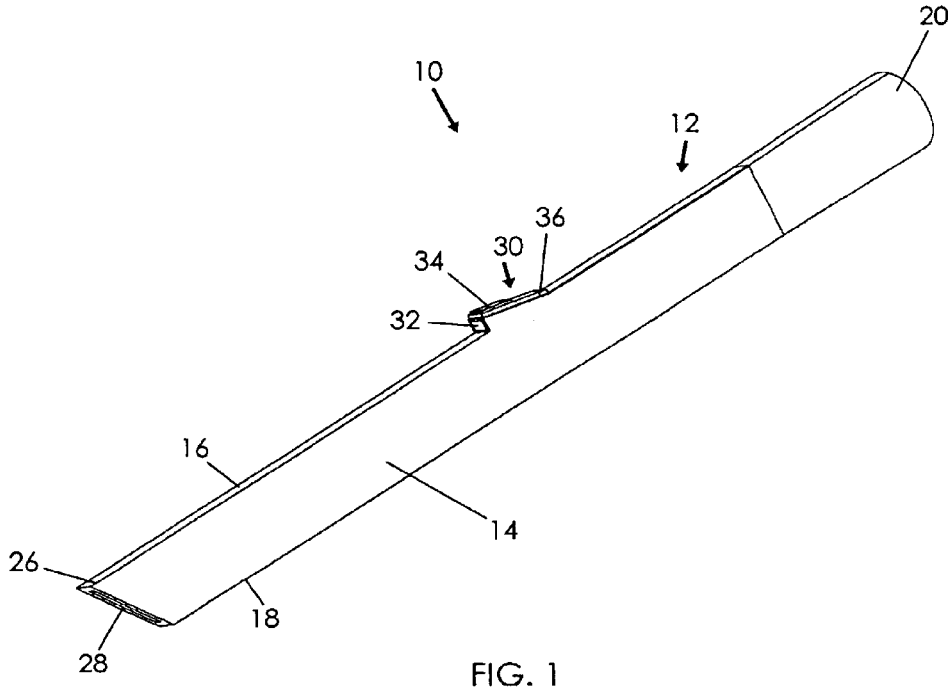
FIG. 1 is a perspective view of a lighted coil cleaning tool according to one embodiment of the invention.
Figures 2A, 2B:
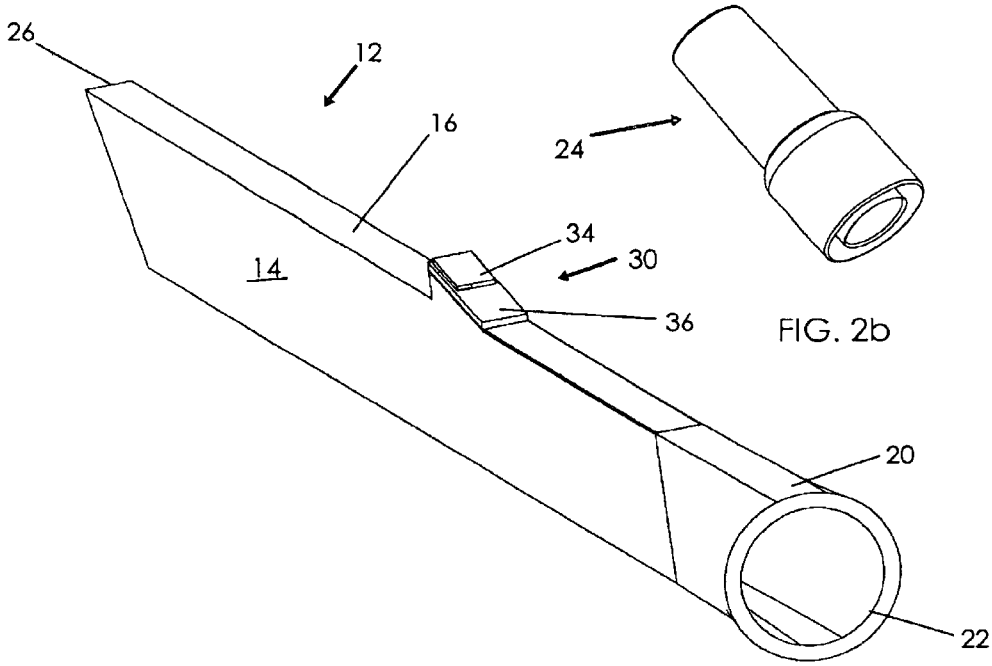
FIG. 2*a* is a perspective view of the coil cleaning tool as in FIG. 1 taken from another angle.
FIG. 2*b* is a perspective view of an adapter for use with the coil cleaning device as in FIG. 1.

A coil cleaning tool for attachment to a vacuum cleaner hose will now be described in detail with reference to FIGS. 1 through 6 of the accompanying drawings. A coil cleaning tool 10 according to one embodiment of the present invention includes a tubular housing 12 having an elongate flattened configuration (FIG. 1). The tubular housing 12 includes a pair of opposed planar side faces 14 connected by short top 16 and bottom 18 walls. The tubular housing 12 has a generally rectangular cross-sectional configuration. The side faces 14 are only slightly spaced apart such that the tubular housing 12 includes a narrow interior width that extends the longitudinal extent of the housing. The tubular housing 12 includes a first end 20 having a configuration capable of being releasably coupled to a conventional vacuum cleaner hose (FIG. 2*a*). More particularly, the first end 20 defines a circular opening 22 and then slopes inwardly to the narrow rectangular configuration of the tubular housing 12. In addition, the coil cleaning tool 10 includes a universal adapter 24 (FIG. 2*b*) that may be frictionally held within the first end 20, the adapter 24 being configured for coupling to a hose of a non-conventional vacuum cleaner such as a shop-vac or the like.

The tubular housing 12 includes a second end 26 oppositely disposed from the first end 20. The second end 26 has a tapered/angled configuration extending between the top _+ and bottom 18 walls (FIG. 1). The second end 26 has a planar surface that defines a primary air intake opening 28. This is the primary opening through which air is suctioned when the vacuum cleaner to which the housing is coupled is energized.

The coil cleaning tool 10 further includes a light housing 30 integrally connected to the top wall 16 of the tubular housing 12 (FIG. 1). The light housing 30 is situated at a point generally midway between the first 20 and second 26 ends of the tubular housing 12 although being positioned adjacent either end would also work. The midpoint position is preferred, however, in that light directed from the housing best illuminates a large portion of a cleaning area in that position and is not easily blocked if the second end 26 is near a wall or other obstruction. A battery (not shown) is positioned within the light housing 30 along with a light emitting diode (LED)_ or other suitable light source, the battery being electrically connected to the LED 32. The light housing 30 defines an opening in a front side thereof through which light from the LED 32 may be directed when energized. The light housing 30 further includes a switch 34 electrically connected to the battery and LED and adapted to selectively regulate the passage of current between the battery and LED 32. Therefore, the LED may be energized upon a user operation of the switch 34 when needed so as to otherwise conserve battery power. The light housing 30 further includes a cover 36 which may be removed for replacement of the LED 32 or battery.

Figure 3:
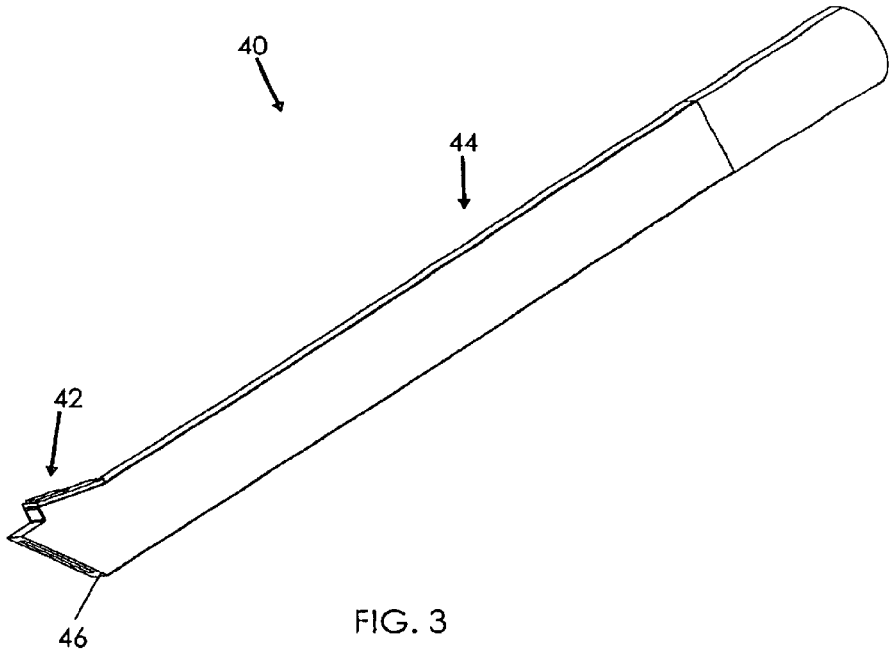
FIG. 3 is a perspective view of a lighted coil cleaning tool according to another embodiment of the present invention.
Figure 4:
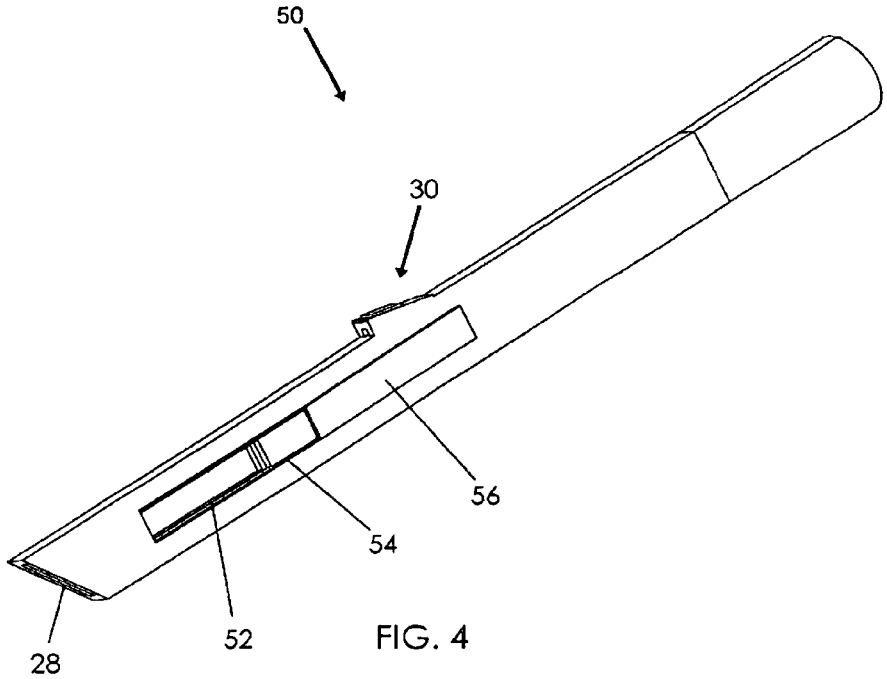
FIG. 4 is a perspective view of a lighted coil cleaning tool according to still another embodiment of the present invention with auxiliary air intake assemblies in an open configuration.
Figure 5:
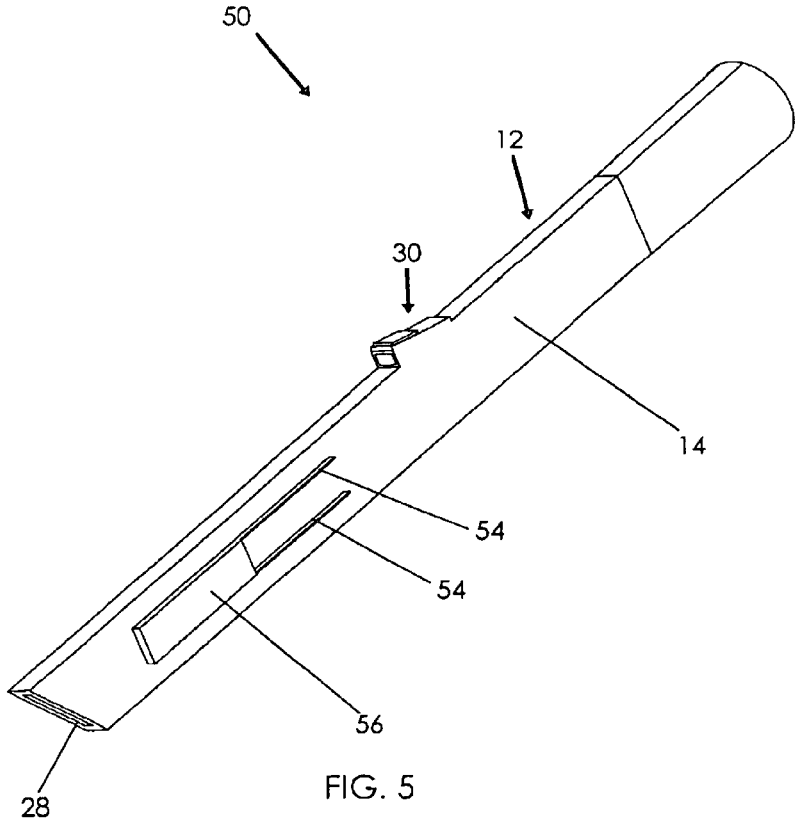
FIG. 5 is a perspective view of the cleaning tool as in FIG. 4 with auxiliary air intake assemblies in a closed configuration.

As discussed above, a coil cleaning tool 40 according to another embodiment may include a light housing 42 positioned adjacent the intake end 46 of the tubular housing 44 (FIG. 3). A coil cleaning tool 50 according to yet another embodiment of the present invention is shown in FIGS. 4 and 5 and includes a construction substantially similar to the embodiment first described herein except as specifically noted below. In this embodiment, each side face 14 includes a cover panel assembly. In each cover panel assembly a respective side face 14 of the tubular housing 12 defines an elongate auxiliary air intake opening 52. Each auxiliary air intake opening 52 is spaced from the second end 26 of the tubular housing 12 and extends longitudinally rearwardly toward the first end 20 (FIG. 4). Further, each cover panel assembly includes a slider track 54 defined by each side face 14. Each slider track 54 extends rearwardly from a corresponding auxiliary air intake opening 52. Each panel 56 is independently slidable between open (FIG. 4) and closed (FIG. 5) configurations relative to corresponding auxiliary air intake openings. Therefore, an appropriate auxiliary air intake opening 52 (or openings) may be accessed by a user as needed to suction a particular cleaning area.

Figure 6:
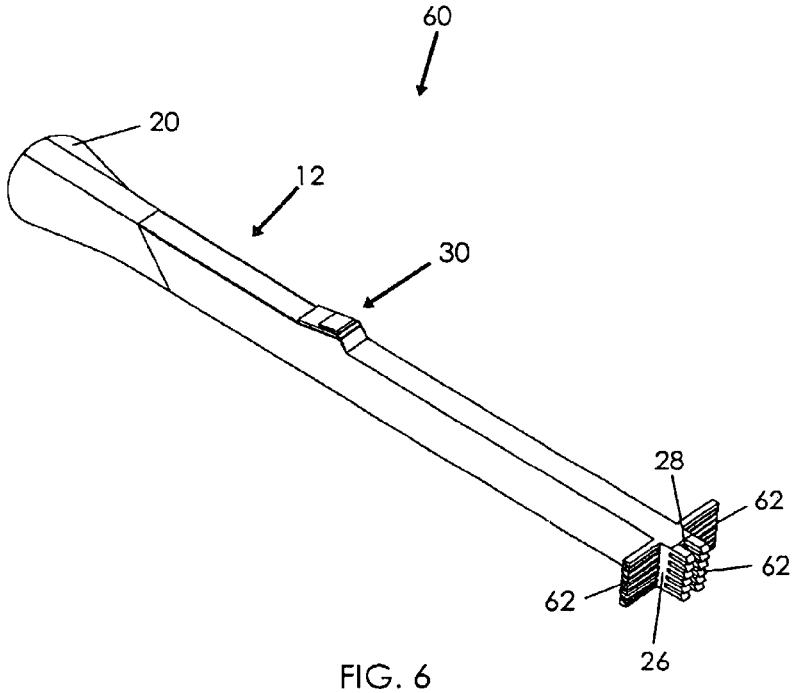
FIG. 6 is a perspective view of a coiling cleaning tool according to yet another embodiment of the present invention.

A coil cleaning tool 60 according to still another embodiment is shown in FIG. 6 and includes a construction substantially similar to the embodiment first described herein except as specifically noted below. In this embodiment, the coil cleaning tool 60 includes a plurality of bristles 62 fixedly attached to the second end 26 of the tubular housing 12 adjacent the primary air intake opening 28. The bristles 62 may extend both longitudinally and perpendicular to the intake opening 28. In use, therefore, the bristles 62 may be rubbed against the refrigerator condenser coils or other surface to be cleaned as dust and the like is suctioned through the primary air intake opening 28.

It is understood that while certain forms of this invention have been illustrated and described, it is not limited thereto except insofar as such limitations are included in the following claims and allowable functional equivalents thereof.

What is claimed is:

1. A coil cleaning tool for attachment to a vacuum cleaner hose, comprising:

an elongate flattened tubular housing having opposed planar side faces with top and bottom walls extending therebetween such that said housing defines a narrow interior width between said side faces, said housing having an end adapted for connection to a vacuum cleaner hose and an opposed end having a tapered construction and defining an air intake opening;

a light source positioned on said top wall of said housing for directing light toward said opposed end thereof when said light source is energized;

a battery positioned on said top wall of said housing for selectively energizing said light source; and a plurality of bristles fixedly attached to said second end of said tubular housing adjacent said primary air intake opening.

2. The coil cleaning tool as in claim 1 further comprising a light housing integrally connected to said top wall, said battery and said light source being positioned in said light housing.

3. The coil cleaning tool as in claim 2 further comprising means for selectively delivering current from said battery to said light source, whereby to selectively energize said light source.

4. The coil cleaning tool as in claim 1 wherein each side face defines an elongate opening spaced from said opposed end and extending longitudinally therealong; said coil cleaning tool further comprising a pair of panels slidably coupled to respective side faces and adapted to selectively cover respective openings.

5. The coil cleaning tool as in claim 1 wherein said tubular housing includes a rectangular cross-sectional configuration.

6. The coil cleaning tool as in claim 1 wherein said light source is positioned at a midpoint between said end and said opposed end, whereby said light from said light source may fully illuminate a cleaning area.

7. The coil cleaning tool as in claim 1 wherein said light source is a light emitting diode.

8. The coil cleaning tool as in claim 1 further comprising a plurality of bristles fixedly attached to said second end of said tubular housing adjacent said primary air intake opening.

9. A coil cleaning tool for attachment to a vacuum cleaner hose, comprising:

an elongate flattened tubular housing having opposed planar side faces with top and bottom walls connecting said side faces such that said housing defines a narrow interior width between said side faces along the longitudinal extent thereof, said housing having a first end adapted for connection to a vacuum cleaner hose and an opposed second end having a tapered construction defining an air intake opening;

each side face defining an elongate auxiliary air intake opening spaced from said second end of said tubular housing and extending longitudinally therealong toward said first end, said auxiliary air intake openings being aligned with one another on respective opposed side faces;

a pair of elongate panels slidably coupled to respective side faces and adapted to selectively cover respective openings, each panel being individually operable to open or close respective auxiliary air intake openings;

a light source positioned on said top wall of said housing for directing light toward said opposed end thereof when said light source is energized; and a battery positioned on said top wall of said housing for selectively energizing said light source.

10. The coil cleaning tool as in claim 9 wherein said light source is a light emitting diode.

11. The coil cleaning tool as in claim 9 further comprising a light housing integrally connected to said top wall, said battery and said light source being positioned in said light housing.

12. The coil cleaning tool as in claim 11 further comprising means for selectively delivering current from said battery to said light source, whereby to selectively energize said light source.

13. The coil cleaning tool as in claim 9 wherein said light source is positioned at a midpoint between said end and said opposed end, whereby said light from said light source may fully illuminate a cleaning area.

14. The coil cleaning tool as in claim 9 wherein said tubular housing includes a rectangular cross-sectional configuration.

15. The coil cleaning tool as in claim 9 further comprising a plurality of bristles fixedly attached to said second end of said tubular housing adjacent said primary air intake opening.

* * * * *